US005947431A

United States Patent [19]

Kiggins

[11] Patent Number: 5,947,431

[45] Date of Patent: Sep. 7, 1999

[54] MERCHANDISE DISPLAY SUPPORT

[75] Inventor: Timothy R. Kiggins, Syracuse, N.Y.

[73] Assignee: Pass & Seymour, Inc., Syacuse, N.Y.

[21] Appl. No.: 08/513,458

[22] Filed: Aug. 10, 1995

[51] Int. Cl.[6] ..... F16M 11/00

[52] U.S. Cl. ..... 248/200; 248/205.1; 248/291.1

[58] Field of Search ..... 248/406, 200, 248/205.1, 205.3, 291.1, 300, 906; 211/87; 446/123, 107, 108, 111; 403/84, 85, 83

[56] References Cited

U.S. PATENT DOCUMENTS

| | | | |
|---|---|---|---|
| 1,433,273 | 10/1922 | Graves | 446/109 |
| 2,014,464 | 9/1935 | Bierbach | 446/123 |
| 5,316,254 | 5/1994 | McCartha | 248/906 |
| 5,386,959 | 2/1995 | Laughlin et al. | 248/205.1 |
| 5,516,068 | 5/1996 | Rice | 248/906 |

*Primary Examiner*—Leslie A. Braun
*Assistant Examiner*—Willie Berry, Jr.
*Attorney, Agent, or Firm*—Bond, Schoeneck & King, LLP; Stephen B. Salai

[57] ABSTRACT

An item of merchandise is mounted for visual and tactile inspection by shoppers in a retail setting upon a support member which is attached to a fixed support conventionally present in the store. Two types of support members, for alternative use, are disclosed. A first of the support members includes openings for passage of screws into a vertically disposed surface such as a pegboard. The other support member includes a U-shaped bracket having outwardly directed flanges for engagement with the spaced channels of a conventional, horizontally disposed track member on the front of a store shelf, or the like. A bracket affixed to the merchandise item may be attached to either of the first and second support members, and the rotational orientation of the item may be selectively varied in accordance with its height above floor level.

18 Claims, 4 Drawing Sheets

MERCHANDISE DISPLAY SUPPORT

BACKGROUND OF THE INVENTION

The present invention relates to supports for the display of items of merchandise in a retail setting. More particularly, the invention relates to hardware for supporting an item of merchandise to permit visual and tactile examination by customers in a location where such items are normally stocked in packaged form.

Many types of relatively small (e.g., hand-held) items are stocked on store shelves in boxes or cartons from which the item must be removed for visual and tactile examination by the shopper. Some types of packaging are designed to permit viewing of portions of the item, e.g., by blister or shrink packaging wherein the item is covered by transparent plastic affixed to an opaque card. However, the items are normally not viewable from all sides and may not be physically handled outside the package, as is often desirable, e.g., with items having parts intended for manual manipulation under conditions of actual use.

It is a principal object of the present invention to provide a simple and economical, yet highly effective and versatile means of displaying merchandise items in a retail environment.

A further object is to provide a physical support for an item of merchandise to permit both complete visual inspection and manual manipulation of moveable parts by a prospective purchaser.

Another object is to provide merchandise display apparatus which permits selective mounting upon either a vertical surface having preformed holes therein, or upon a conventional track or channel member on the front edge of a store shelf.

Still another object is to provide support means for an item of merchandise which permit display of the item in any one of a plurality of rotational orientations, depending upon its height above floor level.

Other objects will in part be obvious and in part appear hereinafter.

SUMMARY OF THE INVENTION

Although the invention may be employed in conjunction with a wide variety of merchandise items, it is disclosed as a support for a dimmer switch including a box-like housing for mounting in a wall. An L-shaped bracket is affixed to the back of the housing with one side of the bracket extending rearwardly from the housing and having a plurality of openings therein.

A first support member is formed from a flat metal rod having a major length portion, e.g. about 12", and a minor length portion, e.g., about 2", extending linearly at 90 degrees to one another. A first pair of spaced openings through the minor length portion are provided for passage of screws to mount the support member upon a vertical surface in a retail sales area. A second pair of spaced openings are provided near the free end of the major length portion for passage of threaded fasteners to affix the bracket on the rear of the merchandise item to the first support member. The plurality of openings in the bracket permit selective positioning of the item in several rotationed orientations depending upon the height above floor level at which the first support member is mounted. A small plate is preferably affixed to the major length portion to provide a surface flush with the minor length portion for added stability of the first support member against the vertical surface upon which it is mounted.

A second mounting member includes a generally U-shaped bracket with outwardly directed flanges or edge portions along each of the free ends. One side of an L-shaped bracket is affixed to the planar, medial portion of the U-shaped bracket. The other side of the L-shaped bracket extends outwardly from the medial portion of the U-shaped bracket in a plane perpendicular thereto. A pair of openings in the other side of the L-shaped bracket are provided for passage of threaded fasteners to releasably connect the L-shaped bracket on the rear of the merchandise item to that of the second mounting member. The outwardly directed flanges on the U-shaped bracket are dimensioned for resilient engagement with the channels of a conventional track member on the front edge of a store shelf. The plurality of openings in the L-shaped bracket on the merchandise item permits selective mounting thereof in a number of rotational orientations with respect to the second support member, as with the first support member.

The first and second support members may be provided, together with a representative merchandise item with the L-shaped bracket affixed thereto as a kit for use by the retailer. Depending upon store layout and facilities, the merchandise item may be mounted upon either the first or the second support member in an appropriate orientation for both complete visual inspection and, where applicable, manual manipulation by the prospective purchasers.

The foregoing and other features and advantages of the invention will be more readily understood an fully appreciated from the following detailed description, taken in conjunction with the accompanying drawings.

DETAILED DESCRIPTION

Figure 1:
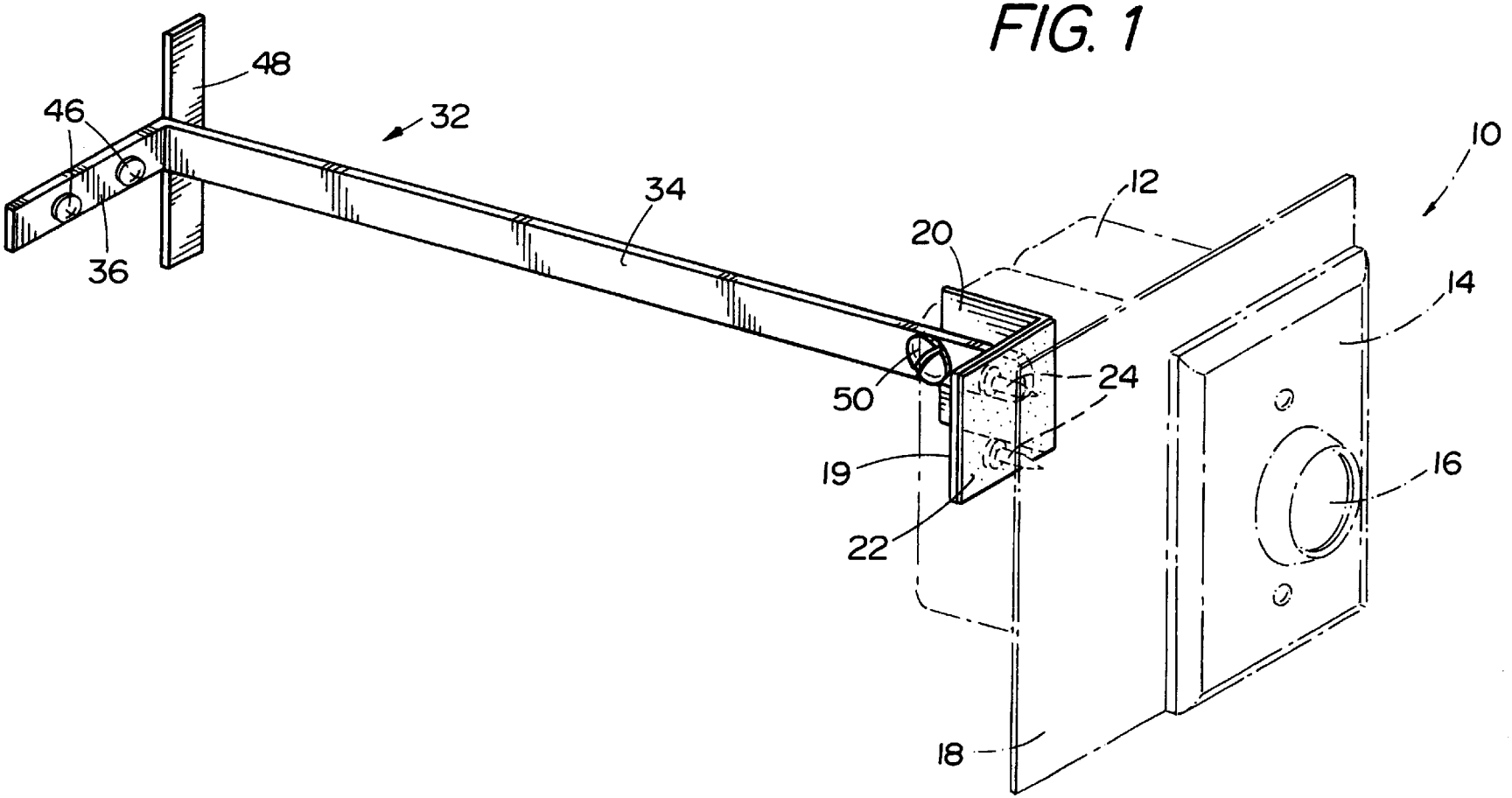
FIG. 1 is a perspective view of a representative merchandise item, shown in phantom lines, supported for display by a first support member of the present invention.
Figure 2:
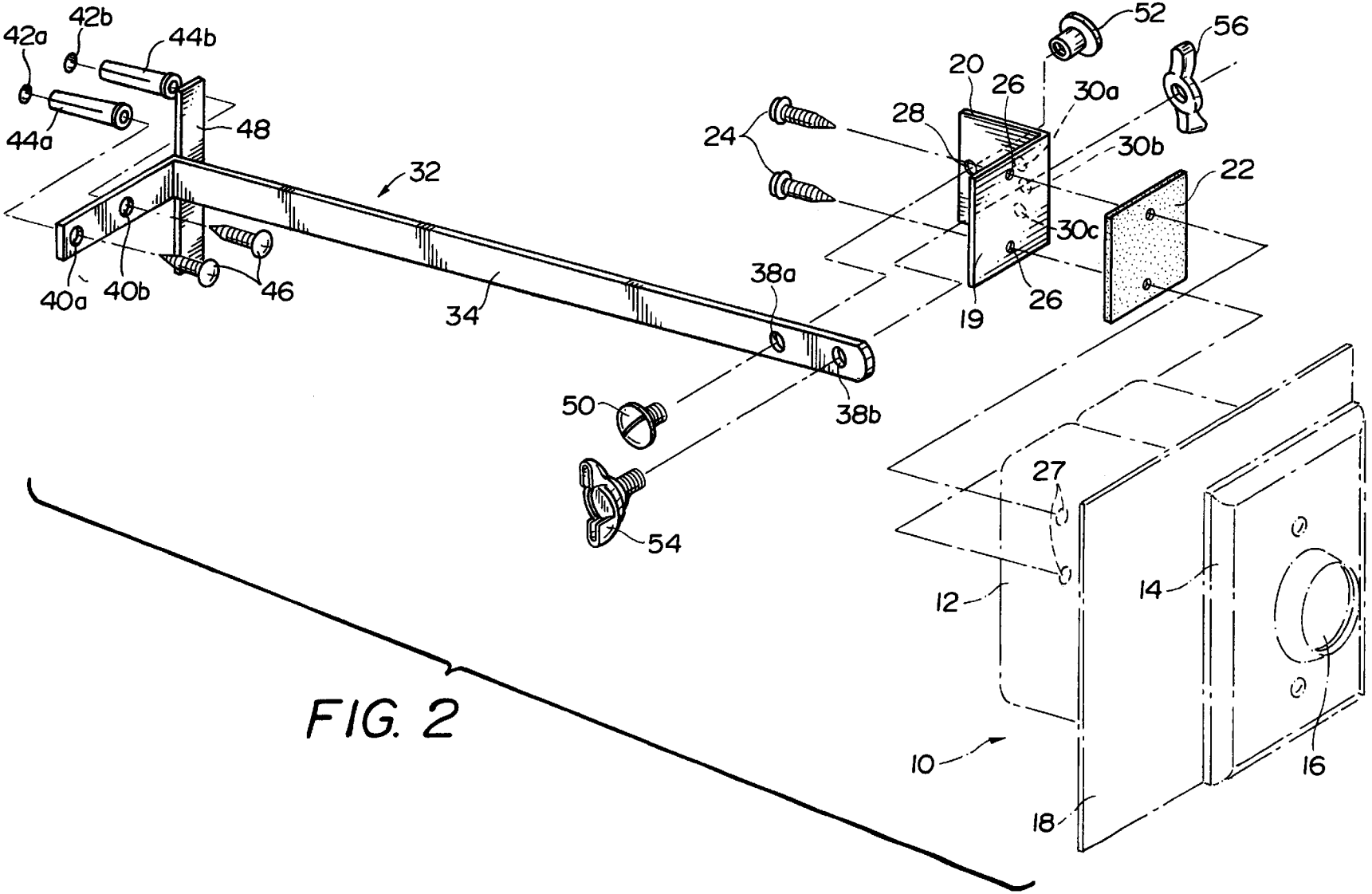
FIG. 2 is an exploded perspective view of the elements of FIG. 1.

Referring now to the drawings, in FIGS. 1 and 2 is shown an item of merchandise for display to customers in a retail setting. The merchandise item selected for illustration is a dimmer-type electric light switch, denoted generally by reference numeral 10 and including a box-like housing 12 for installation in a wall opening, a wall plate 14 to cover the openings in the wall and the front of housing 12, and operating knob 16 which may be both pushed to effect on-off control, and turned to effect brightness control. Card 18, bearing printed information concering switch 10, is held between housing 12 and wall plate 14. These elements are shown in phantom lines since the support means of the invention may be employed with a wide variety of merchandise items, and the particular type or structure of the item is of no consequence, provided it is a three-dimensional item of relatively small size, i.e., susceptible of being hand-held, and includes a substantially planar surface portion, in this case a portion the rear surface of housing 12.

An L-shaped bracket, having first and second, essentially planar portions 19 and 20, respectively, is securely fastened to the planar rear surface portion of housing 12. In the illustrated embodiment, first portion 19 of the bracket is affixed to housing 12 by either or both of a double-sided adhesive sheet 22 and screws 24, the latter extending through openings 26 in first portion 19 and in sheet 22, if present, and threaded into openings 27 in housing 12. A plurality of through openings in second bracket portion 20 include first opening 28 and a plurality of second openings 30*a*, 30*b* and 30*c*. The center-to-center distance from first opening 28 to each of openings 30*a*, 30*b* and 30*c* is substantially equal.

A first support member, denoted generally by reference numeral 32, includes a flat metal rod having major and minor length portions 34 and 36, respectively, extending along linear, perpendicular axes. A pair of opening 38*a* and 38*b* are spaced from one another along the axis of major length portion 34, near what is termed the proximal end of support member 32. Another pair of openings 40*a* and 40*b* are provided in minor length portion 36 at the distal end.

Support member 32 is designed for mounting upon a vertical surface having a pair of preformed openings 42*a* and 42*b*, horizontally spaced for alignment therewith of openings 40*a* and 40*b* , respectively. Conventional, hollow, expansible anchors 44*a* and 44*b* may be inserted into openings 42*a* and 42*b*, respectively, where appropriate to receive screws 46. Openings 42*a* and 42*b* may be a pair of the plurality of evenly-spaced openings arranged in perpendicular rows and columns in a sheet of so-called pegboard such as is often provided as a vertical support for rods upon which packaged merchandise items are hung.

Flat metal strip 48 is permanently attached, e.g., by welding, along one edge at the juncture of major and minor length portions 34 and 36, to complete support member 32. When support member 32 is mounted in the indicated manner, with the longitudinal axes of both major and minor length portions 34 and 36 horizontally disposed, the longitudinal axis of strip 48 is vertical and its rear surface is coplanar with that of minor length portion 36. Thus, the rear surface of strip 48 bears against the vertical surface upon which support member 32 is mounted to provide added stability.

Switch 10 is removably mounted upon support member 32 by a pair of threaded fasteners, each having two parts. Externally threaded element 50 is received in internally threaded element 52 as the elements extend through aligned openings 28 and 38*a* of bracket portion 20 and support member portion 34, respectively. Screw element 54 extends through opening 38*b* in support member portion 34 and through one of openings 30*a*, 30*b* and 30*c* in bracket portion 20, and is secured by wing nut 56.

Figure 3:
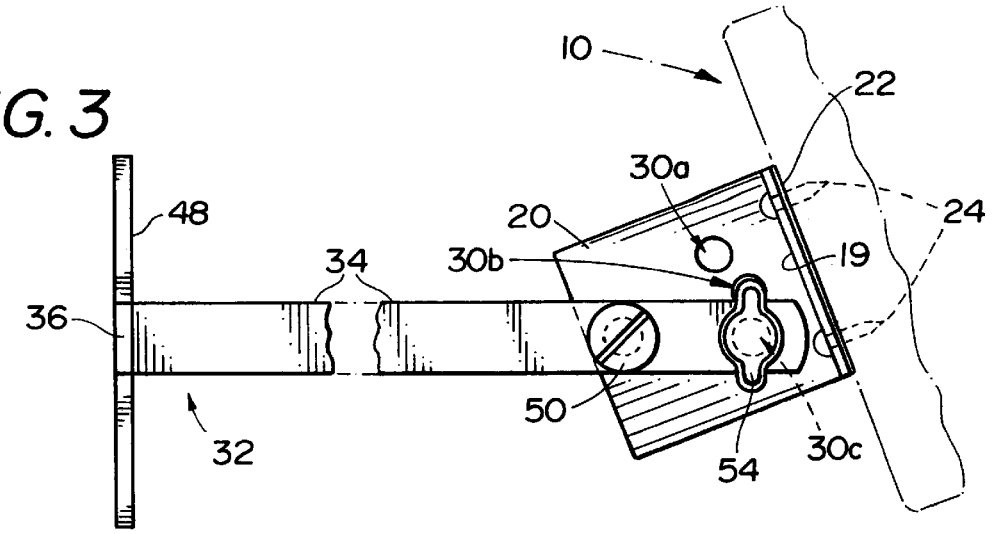
FIGS. 3–5 are fragmentary, side elevational views of the elements of FIGS. 1 and 2, showing the merchandise item in a plurality of selective rotational orientations with respect to the support member.
Figure 4:
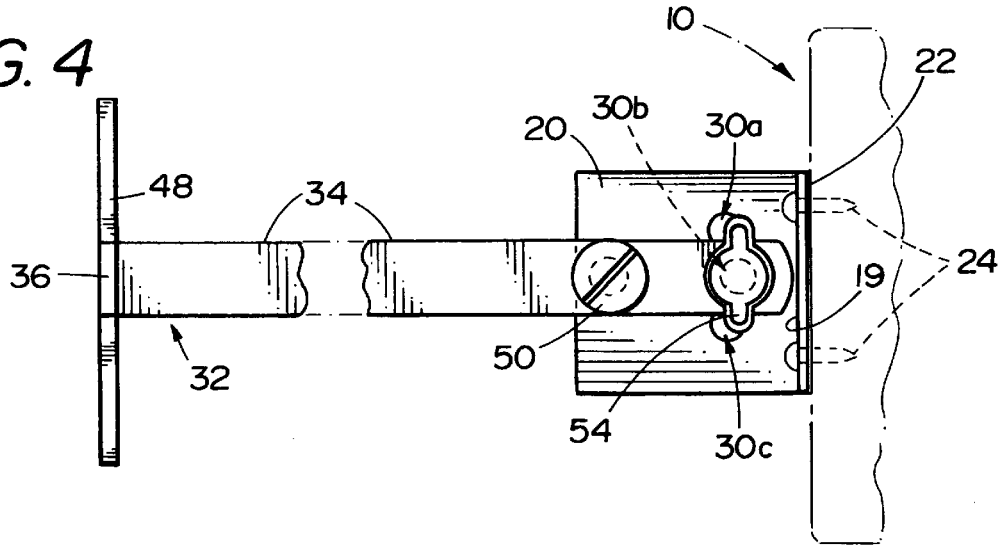
Figure 5:
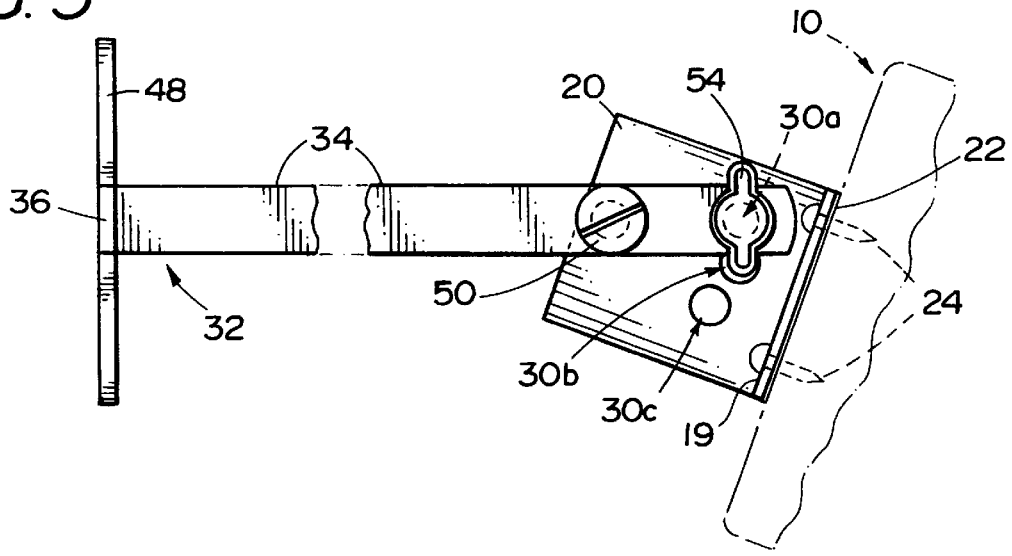

FIGS. 3, 4 and 5 illustrate the three, selective rotational orientations of the merchandise item with respect to the support member. The orientation selected is that which places the item most nearly in the line of sight of a shopper standing in front of the display. For example, if support member 32 is mounted at a position significantly below eye level, opening 30*c* is aligned with opening 38*b* and screw element 54 is inserted through the aligned openings to place switch 10 with its front face tilted upwardly, as shown in FIG. 3. If support member is mounted at or near average eye level, central opening 30*b* is aligned with opening 38*b* as seen in FIG. 4. Also, as seen in FIG. 5, switch 10 may be placed in a downwardly tilted orientation when support member 32 is positioned a significant distance above average eye level.

Figure 6:
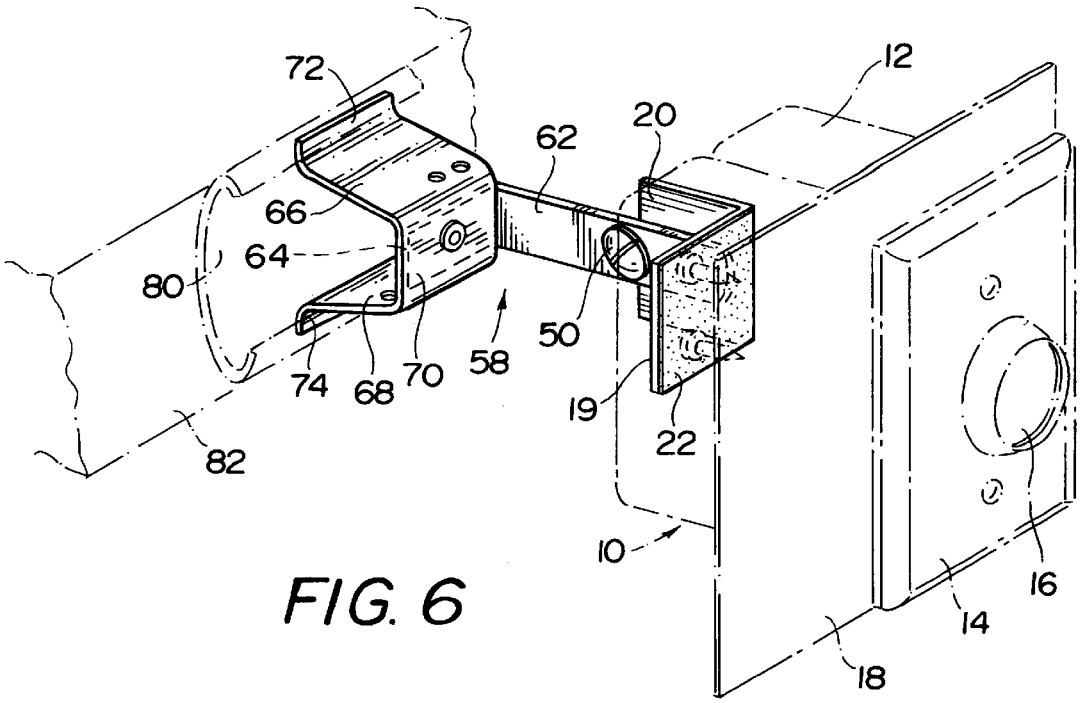
FIG. 6 is a perspective view of the merchandise item supported for display by a second support member, useable alternatively to the support member of FIGS. 1–5.
Figure 7:
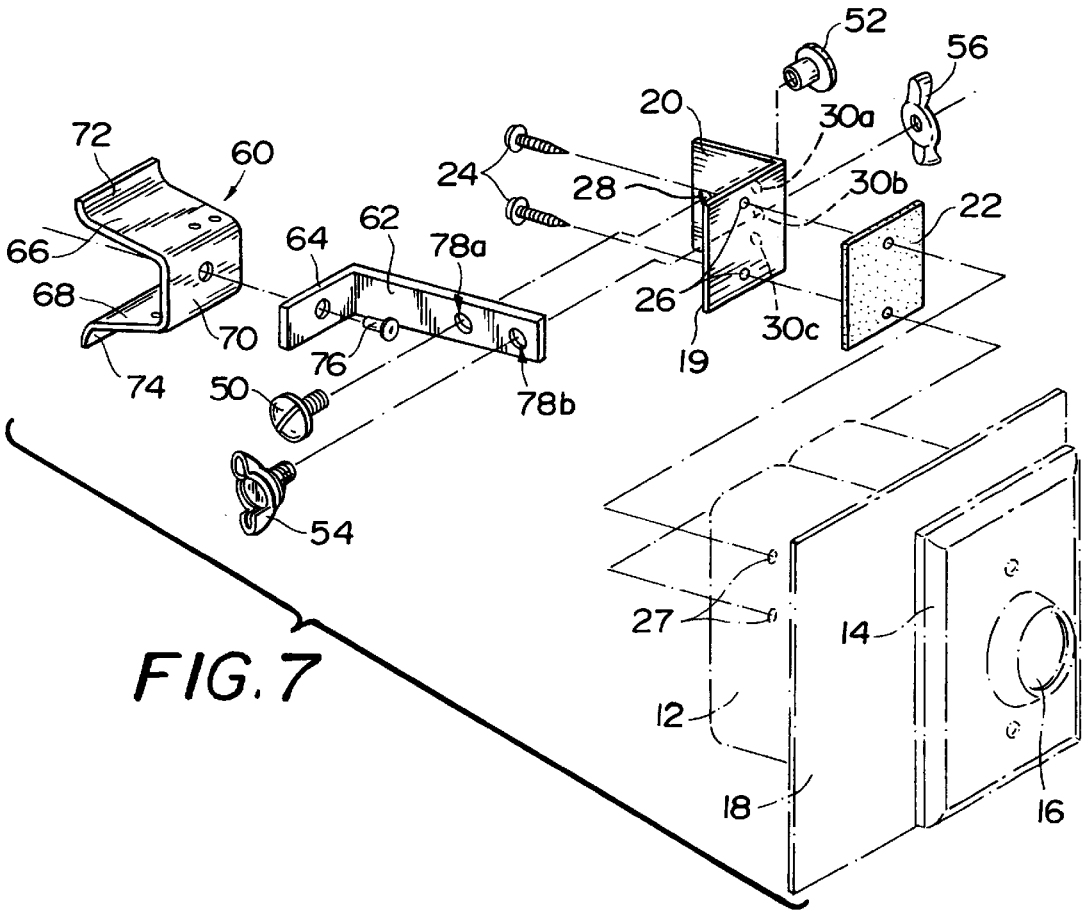
FIG. 7 is an exploded perspective view of the elements of FIG. 6.

Turning now to FIGS. 6 and 7, a second form of support member, indicated by reference numeral 58, is provided for use alternatively to support member 32. The L-shaped bracket having portions 19 and 20 is affixed to the rear, planar surface portion of dimmer switch 10 as previously described. Support member 58 comprises substantially U-shaped bracket 60 and a further L-shaped bracket having essentially planar portions 62 and 64 disposed in perpendicular planes. U-shaped bracket 60 includes a pair of arms 66 and 68, connected by medial portion 70 and having outwardly directed flanges 72 and 74 extending along their respective free ends.

Portion 64 of the L-shaped bracket is fixedly attached to medial portion 70 of U-shaped bracket 60 by any desired means such as illustrated rivet 76. A pair of openings 78*a* and 78*b* are provided in portion 62 of the L-shaped bracket, spaced along its longitudinal axis. Dimmer switch 10 is detachably mounted upon support member 58 in essentially the same manner as its previously described mounting upon support member 32. That is, threaded fastening elements 50 and 52 are mutually secured in aligned openings 28 and 78*a*, and screw element 54 extends through opening 78*b* and one of openings 30*a*, 30*b* and 30*c* aligned therewith.

Support member 58 is designed for mounting upon a conventional track member such as those commonly attached to the front edges of store shelves for holding price tags, or the like, in proximity to merchandise stocked on the shelves. A fragment of such a track member is shown in phantom lines in FIG. 6, denoted by reference numeral 80 and mounted on the front edge of store shelf 82. A limited amount of resilience of U-shaped bracket 60 permits the free ends of arms 66 and 68 thereof to be moved a short distance toward one another, whereby flanges 72 and 74 may be inserted in the horizontally disposed channels on each side of track member 80. Alternately, flanges 72 and 74 may be slid into the spaced channels of track member 80 from one end thereof. Dimmer switch 10 is then displayed in a position forwardly of the store shelf, as illustrated in FIG. 6. Of course, switch 10 may be placed in any of the previously described rotational orientations about the horizontal axis of threaded fasteners 50 and 52 with respect to mounting member 58.

From the foregoing, it will be appreciated that the present invention provides a unique and commercially effective means of displaying merchandise items in a retail setting. An actual item or product corresponding to that which the customer would normally purchase in a closed package, is supported in a conspicuous position and orientation for visual inspection and, where appropriate, for manual manipulation by the customer. Support members are disclosed in two embodiments, for alternate use by removable attachment to structure, e.g., a pegboard or shelf-front track member, normally found in retail establishments.

What is claimed is:

1. Apparatus for displaying to shoppers in a retail store a three-dimensional item of merchandise having a substantially planar surface, said apparatus comprising:

a) a substantially L-shaped bracket having a first portion adapted to be fixedly attached to the planar surface and a second portion extending integrally outwardly from said first portion, each of said first and second portions being substantially planar and disposed in mutually perpendicular planes, said second portion having a plurality of through openings including a first opening and a set of at least three second openings, a center-to-center distance between said first opening and each of said second openings being substantially equal;

b) a support member having proximal and distal ends, said proximal end having at least one preformed through-opening for alignment with at least one of said second openings in said second portion of said substantially L-shaped bracket;

c) a first attachment system for attaching said proximal end to said second portion of said bracket; and d) a second attachment system for attaching said distal end to a fixed support, wherein said at least one preformed through-opening in said proximal end includes, a first pair of preformed through openings spaced for alignment with said first opening and any one of said second openings in said second portion of said bracket, and said first attachment system comprises a pair of fasteners extending through respective sets of aligned openings in said proximal end and said second portion of said bracket.

2. The apparatus of claim 1 wherein said second attachment comprises at least one preformed opening in said distal end and a fastener extending through said at least one opening in said distal end and adapted to extend into said fixed support.

3. The apparatus of claim 2 wherein said support member comprises an elongated rod having a major length portion extending along a first, longitudinal axis of said support member, and a minor length portion at said distal end extending along a second, longitudinal axis of said support member substantially perpendicular to said first longitudinal axis.

4. The apparatus of claim 3 wherein said major length portion includes a pair of preformed through-openings spaced along said first, longitudinal axis adjacent said proximal end.

5. The apparatus of claim 4 wherein said first attachment system comprises first and second fastening means respectively extending through said pair of preformed through openings in said major length portion and through two of said plurality of through openings in said second portion of said L-shaped bracket aligned therewith.

6. The apparatus of claim 5 wherein the center-to-center distance between said primary opening and each of said secondary openings being substantially equal to the center-to-enter distance between said pair of preformed through openings in said major length portion, whereby said primary opening may be aligned with one opening in said pair of preformed through openings, and any one of said secondary openings may be aligned with the other opening in said pair of preformed through openings.

7. The apparatus of claim 1 wherein a longitudinal axis of said support member crosses a plane of said first portion of said bracket at an angle, said angle varying dependent on which one of said second openings is selected.

8. The apparatus of claim 1 wherein said support member has a longitudinal axis with said proximal end and a portion of said distal end lying along said longitudinal axis.

9. The apparatus of claim 8 wherein said support member has a length of approximately 12 inches from said proximal end to said distal end.

10. The apparatus of claim 1 wherein said at least one preformed through-opening in said proximal end includes a fast pair of preformed through openings and wherein the center-to-center distance between said first opening and any one of said second openings is substantially equal to a center-to-center distance between the pair of preformed openings in the proximal end of the support member, whereby said primary opening may be aligned with one opening in said pair of preformed openings, and any one of said second openings may be aligned with the other opening in said pair of preformed openings.

11. The apparatus of claim 1 wherein said support member comprises a major length portion and a minor length portion extending perpendicularly from said major portion, wherein the major length portion includes the proximal end of the support member and wherein the minor length portion includes at least a portion of the second attachment system.

12. The apparatus of claim 11 wherein at least one opening is provided in the minor length portion for alignment with an opening in the fixed support.

13. Apparatus for displaying to shoppers in a retail store a three-dimensional item of merchandise having a substantially planar surface, said apparatus comprising:

a) a substantially L-shaped bracket having a first portion adapted to be fixedly attached to the planar surface and a second portion extending integrally outwardly from said first portion, each of said first and second portions being substantially planar and disposed in mutually perpendicular planes, said second portion including a plurality of through openings;

b) a support member having proximal and distal ends;

c) a first attachment system for attaching said proximal end to said second portion of said bracket; and d) a second attachment system for attaching said distal end to a fixed support, wherein said second attachment system comprises a substantially U-shaped bracket having a pair of outwardly extending flanges along its respective free ends for releasably attaching said support member to a conventional track member defining spaced channels extending along the forward edge of a store shelf, the flanges adapted to engage within the spaced channels.

14. The apparatus of claim 13 wherein said first attachment system comprises fastening means for attaching said second portion of said L-shaped bracket to said proximal end of said support member.

15. The apparatus of claim 14 wherein said fastening means comprises at least one threaded fastener extending through aligned openings in said second portion of said L-shaped bracket and said proximal end of said support member.

16. The apparatus of claim 14 wherein said fastening means comprises means for selectively varying the angular orientation of said L-shaped bracket, and thereby said item of merchandise with respect to said support member.

17. Apparatus for displaying to shoppers in a retail store a three-dimensional item of merchandise comprising:

a bracket having a first portion adapted to be fixedly attached to a planar surface of an item of merchandise and a second portion extending integrally outwardly from said first portion, said second portion having a plurality of openings including a first opening and a set of at least two second openings, a center-to-center distance between said first opening and each of said second openings being substantially equal;

a support member having a proximal end and a distal end, said proximal end having a pair of preformed openings wherein the center-to-center distance between said first opening and any one of said second openings is substantially equal to a center-to-center distance between the pair of preformed openings in the proximal end of the support member, whereby said primary opening may be aligned with one opening in said pair of preformed openings, and any one of said second openings may be aligned with the other opening in sad pair of preformed openings, wherein said proximal end is releasably attachable to said second portion, and wherein said distal end is attachable to a fixed support; and, releasable fastening means for selectively fastening said pair of preformed openings in said proximal end of said support member to the first opening and one of the at least two second openings in said second portion of said bracket.

18. Apparatus for displaying to shoppers in a retail store a three-dimensional item of merchandise having a substantially planar surface, said apparatus comprising:

a) a substantially L-shaped bracket having a first portion adapted to be fixedly attached to the planar surface and a second portion extending integrally outwardly from said first portion, each of said first and second portions being substantially planar and disposed in mutually perpendicular planes, said second portion including a primary opening and at least three secondary openings, the center-to-center distance between said primary opening and each of said secondary openings being substantially equal;

b) a support member having proximal and distal ends, and comprising an elongated rod having a major length portion extending along a first, longitudinal axis of said support member, and a minor length portion at said distal end extending along a second, longitudinal axis of said support member substantially perpendicular to said first longitudinal axis, said major length portion including a pair of preformed through-openings spaced along said first, longitudinal axis adjacent said proximal end and having a center-to-center distance equal to the center-to-center distance between the primary opening and each of the secondary openings in the second portion of the L-shaped bracket;

c) first fastening means extending through and aligning one opening in said pair of preformed through openings and said primary opening, and second fastening means extending through and aligning the other opening in said pair of preformed openings and any one of said secondary openings for attaching said proximal end to said second portion of said bracket; and d) at least one preformed opening in said distal end and a fastener extending through said at least one opening in said distal end and adapted to extend into a fixed support for attaching said distal end to the fixed support.

* * * * *